US006726537B1

(12) United States Patent
Crevasse et al.

(10) Patent No.: US 6,726,537 B1
(45) Date of Patent: Apr. 27, 2004

(54) POLISHING CARRIER HEAD

(75) Inventors: Annette M. Crevasse, Apopka, FL (US); William G. Easter, Orlando, FL (US); John A. Maze, Clermont, FL (US); Frank Miceli, Orlando, FL (US)

(73) Assignee: Agere Systems Inc., Allentown, PA (US)

( * ) Notice: Subject to any disclaimer, the term of this patent is extended or adjusted under 35 U.S.C. 154(b) by 0 days.

(21) Appl. No.: 09/553,931

(22) Filed: Apr. 21, 2000

(51) Int. Cl.[7] ..... B24B 47/02
(52) U.S. Cl. ..... 451/41; 451/365; 269/71
(58) Field of Search ..... 451/365.41, 385, 451/398, 285, 287–290; 269/22, 71, 283, 903; 29/281.1, 282

(56) References Cited

U.S. PATENT DOCUMENTS 4,813,185 A * 3/1989 Demay ..... 451/365 X
5,554,067 A * 9/1996 Lecerf et al. ..... 451/365 X
5,820,448 A * 10/1998 Shamouilian et al. ..... 451/287
5,899,800 A * 5/1999 Shendon ..... 451/287
5,944,590 A * 8/1999 Isobe et al. ..... 451/288
6,346,036 B1 * 2/2000 Halley ..... 451/285
6,050,882 A * 4/2000 Chen ..... 451/285
6,110,025 A * 8/2000 Williams et al. ..... 451/286
6,113,468 A * 9/2000 Natalicio ..... 451/41

* cited by examiner

*Primary Examiner*—Joseph J. Hail, III
*Assistant Examiner*—Anthony Ojini

(57) ABSTRACT

The present invention provides a method for manufacturing an integrated circuit using a polishing head in a polishing apparatus. In one advantageous embodiment, the polishing head comprises a wafer carrier having an outer periphery and a wafer holder. The wafer holder is coupled to the wafer carrier and depends from the outer periphery thereof. The wafer holder is configured (i.e., designed) to grip an edge of the semiconductor wafer.

4 Claims, 4 Drawing Sheets

POLISHING CARRIER HEAD

TECHNICAL FIELD OF THE INVENTION

The present invention is directed, in general, to a semiconductor wafer polishing apparatus and, more specifically, to a semiconductor wafer carrier that is capable of grasping the edge of the semiconductor wafer during a chemical/mechanical polishing process.

BACKGROUND OF THE INVENTION

Conventional chemical/mechanical polishing (CMP) has been developed for providing smooth topographies of the various layers formed during semiconductor device manufacture. The CMP process involves holding, and rotating, a thin, reasonably flat, semiconductor wafer against a rotating polishing platen. The wafer may be repositioned radially within a set range on the polishing platen as the platen is rotated. The polishing surface, which is conventionally an open-celled, polyurethane pad affixed to the polishing platen, is wetted by a chemical slurry, under controlled chemical, pressure, and temperature conditions. The chemical slurry contains selected chemicals which etch or oxidize selected surfaces of the wafer during CMP in preparation for their mechanical removal. The slurry also contains a polishing agent, such as alumina or silica, that is used as the abrasive material for the physical removal of the etched/oxidized material. The combination of chemical and mechanical removal of material during polishing results in superior planarization of the polished surface. In this process it is important to remove a sufficient amount of material to provide a smooth surface, without removing an excessive amount of underlying materials at each level of the manufacturing process to insure uniform and accurate formation of the semiconductor device at all subsequent levels. Accurate material removal is particularly important in today's sub-quarter micron technologies where it is critical to minimize thickness variation because the metal lines are getting thinner.

The semiconductor wafer is typically transported to the polishing platen by applying a vacuum against the back of the wafer through the carrier head. This holds the wafer in the carrier head and the vacuum is continually applied until the wafer is placed on the polishing pad. While this system does work well in most instances, the vacuum applied to the wafer can sometimes lead to wafer breakage. When this occurs, fragments of the wafer and slurry can find their way into the vacuum system, which can cause the vacuum system to malfunction. In such instances, the apparatus must be taken off line for cleaning and repair. This, of course, causes delays in the manufacturing process. In addition the wafer breakage can lead to increased overall fabrication costs.

Another problem arises with a conventional polishing apparatus in that once the wafer is positioned on the polishing pad, the wafer is allowed to "free float" within the confines of the carrier ring during the polishing process. Due to allowable variations in the diameter of semiconductor wafers, a small diameter wafer may then move around somewhat within the carrier ring. This causes the center of the semiconductor wafer to be non-aligned to the centerline of the carrier head during polishing. As a result, the wafer surface may develop irregular topographies on the surface being polished, which is highly undesirable.

Accordingly, what is needed in the art is an apparatus that avoids the deficiencies of the prior art for semiconductor wafer CMP.

SUMMARY OF THE INVENTION

To address the above-discussed deficiencies of the prior art, the present invention provides a method for manufacturing an integrated circuit using a polishing head in a polishing apparatus. In one advantageous embodiment, the polishing head comprises a wafer carrier having an outer periphery and a wafer holder. The wafer holder is coupled to the wafer carrier and depends from the outer periphery thereof. The wafer holder is configured (i.e., designed) to grip an edge of the semiconductor wafer.

Thus in one aspect, the present invention provides a semiconductor wafer carrier that comprises a wafer holder configured to grip the semiconductor wafer by its edge for chemical/mechanical polishing; that is, the wafer holder has an overall design that allows it to grip the wafer, versus holding the wafer by only a vacuum. This configuration provides a more continuous connection between the semiconductor wafer edge and the wafer holder, thereby minimizing the opportunity for slurry to migrate to the back side of the wafer and canting of the wafer in the carrier head.

In one embodiment, the wafer holder comprises a collet configured to contract about the wafer edge such that it can grip a fabrication wafer. In an alternative embodiment, the collet comprises an annular band configured to contract about its edge. In one particular aspect of this embodiment, the collet comprises arcuate segments configured to contract radially about its edge. In a related embodiment, the polishing head further comprises guides coupled to the arcuate segments and are configured to guide the arcuate segments as the arcuate segments contract radially about the edge.

In an embodiment to be illustrated and described, the polishing head further comprises an annulus coupled to the wafer carrier and to the arcuate segments with the annulus depending from the outer periphery. The polishing head may further comprise a contraction device coupled to the wafer holder and that is configured to exert a contraction force on the wafer holder. The wafer holder may be operated, for example, by a vacuum, pneumatic, hydraulic, mechanical, or electrical power source.

The wafer carrier, in yet another embodiment, further comprises an inner face and depth sensors. The depth sensors are configured to position the inner face at a prescribed distance from a surface of the semiconductor wafer that opposes the inner face. The depth sensors may be designed to be retractable into the inner face. In another embodiment, the wafer carrier further includes a wafer polishing film interposed the semiconductor wafer and the wafer carrier.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1A:
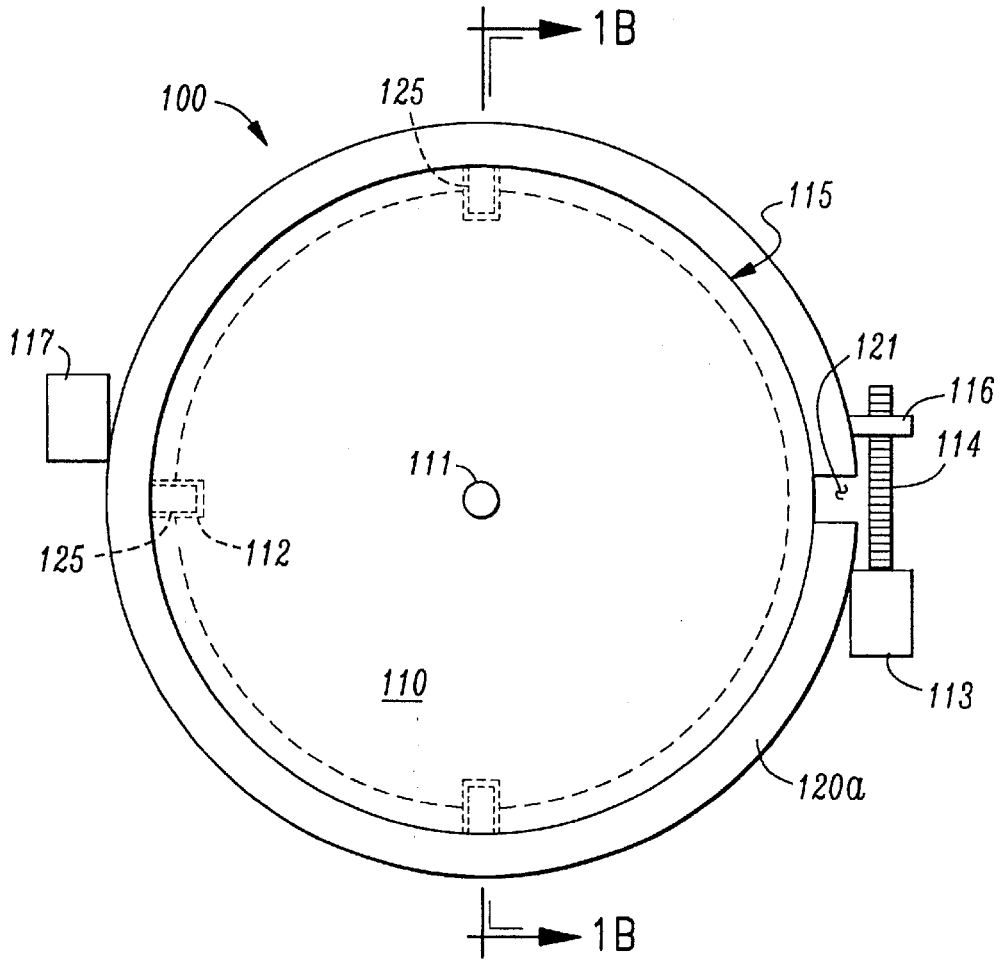
FIGS. 1A and 1B illustrate plan and sectional views of one embodiment of a polishing head constructed according to the principles of the present invention.
Figure 1B:
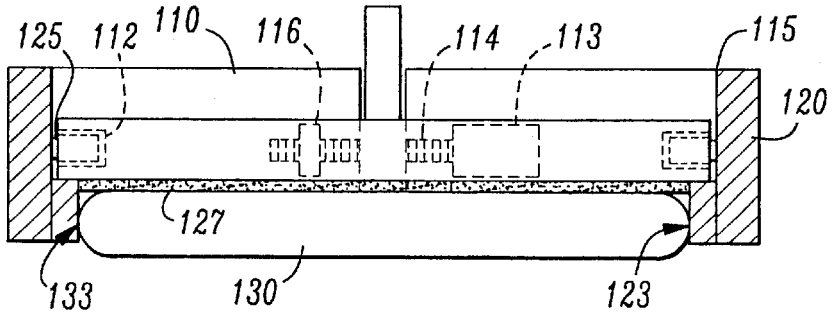

Referring now to FIGS. 1A and 1B, illustrated are plan and sectional views, respectively, of one embodiment of a polishing head 100 constructed according to the principles of the present invention. The polishing head 100 comprises a wafer carrier 110 having an outer periphery 115, a conventional carrier film 127, and a wafer holder 120. In one embodiment, the wafer holder 120 is a collet coupled to the wafer carrier 110 and depends from the outer periphery 115. The collet may be a metal band, collar, ferrule, or flange that can be contracted to grip a wafer. Another example of how the wafer holder 120 may be embodied is in the form of individual fingers or gripping components, similar to those found in drill bit sockets, that are cooperatively coupled to grip the edge of a wafer. In the illustrated embodiment, the wafer holder 120 has an inner surface 123 that is capable of gripping a semiconductor wafer 130 by an edge 133 thereof. The carrier film 127 is located between the wafer carrier 110 and the semiconductor wafer 130. In the illustrated embodiment, the wafer holder 120 is an annular band, designated 120*a*, having a gap 121 with the annular band 120*a* configured to contract about the edge 133.

The wafer carrier 110 may further include a contraction device 113, that is, in this embodiment, an electric motor 113 coupled to a screw 114 threaded through a nut 116 affixed to the annular band 120*a*, and a counterbalance 117. Annular guide slots 112 and the annular band 120*a* may include guides 125 that cooperate to enable the annular band 120*a* to contract uniformly about a center 111 of the wafer carrier 110. Of course, the small electric motor 113 may also be used to expand the annular band 120*a* to allow the semiconductor wafer 130 to be installed or removed. One who is skilled in the art will easily recognize that alternatively, a second electric motor (not shown) may replace the counterbalance 117 and operate a screw (not shown) that closes the annular band 120*a* over a second gap (not shown) and about the edge 133 thereby gripping the semiconductor wafer 130 about the edge 133.

Figure 2A:
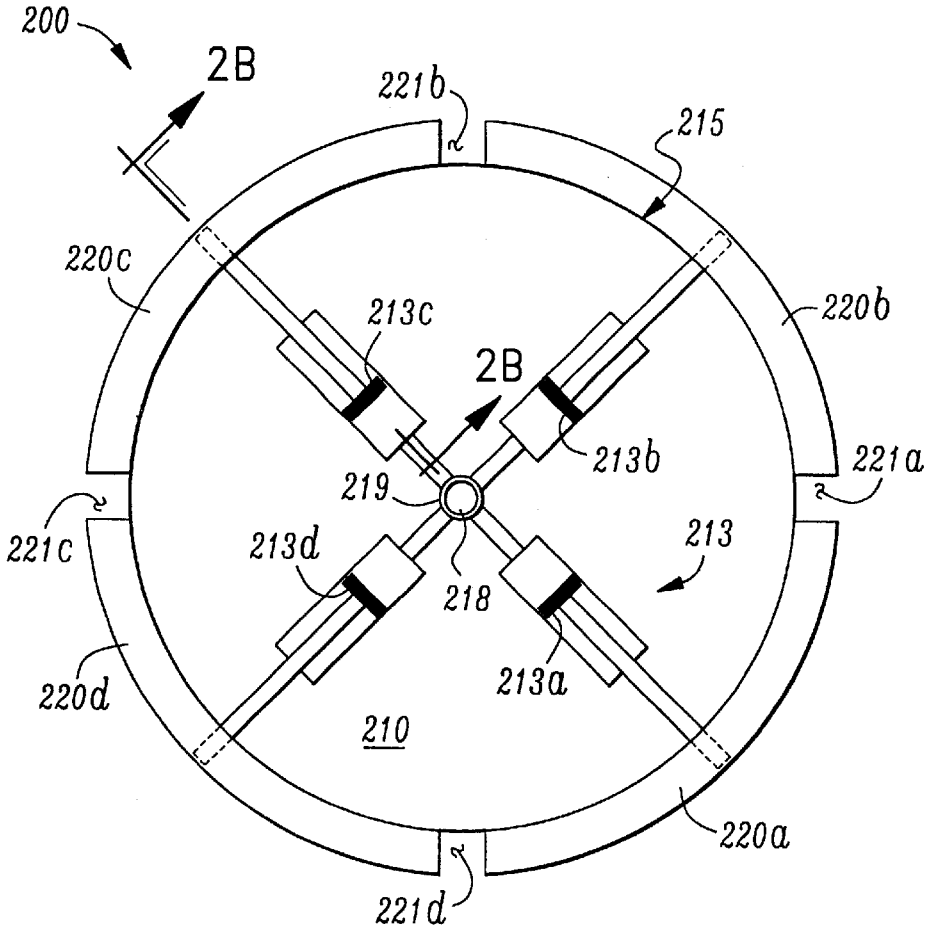
FIGS. 2A and 2B illustrate plan and sectional views of an alternative embodiment of the polishing head of FIGS. 1A and 1B.
Figure 2B:
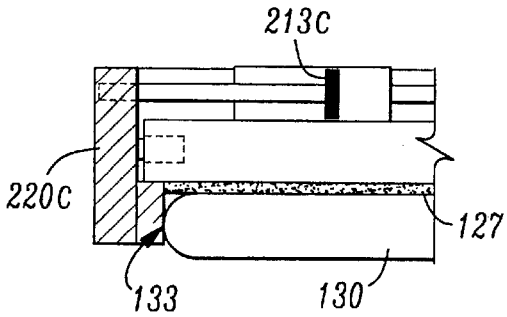

Referring now to FIGS. 2A and 2B, illustrated are plan and sectional views of an alternative embodiment of the polishing head of FIGS. 1A and 1B. In this embodiment, a polishing head 200 comprises a wafer carrier 210 having an outer periphery 215 and a wafer holder, collectively designated 220, descending therefrom. In one embodiment, the wafer holder 220 may comprise arcuate segments 220*a*–220*d*, configured to contract radially about the edge 133. The arcuate segments 220*a*–220*d* have gaps 221*a*–221*d* between adjacent segments 220*a*–220*d* to allow clearance for the wafer holder 220 to contract radially about the edge 133. The gaps 221*a*–221*d* are sized to be minimal with the smallest diameter semiconductor wafer 130, and only slightly larger with the largest diameter semiconductor wafer 130. Thus, any space between the semiconductor wafer edge 133 and the arcuate segments 220*a*–220*d* is reduced to the minimal gaps 221*a*–221*d*. These minimal gaps along with the carrier film 127, interposed the wafer carrier 210 and the semiconductor wafer 230, cooperate to minimize slurry penetration behind the wafer 130. Additionally, the present invention allows elimination of the vacuum system of prior art used to hold the semiconductor wafers during movement to and from a supply/holding point, if so desired. However, other embodiments may still incorporate limited use of a vacuum system. The reduced use the vacuum system, in turn, substantially reduces contamination of the vacuum system by slurry or wafer particles from wafer breakage. One who is skilled in the art will readily recognize that the radially-retracting segmented wafer holder 220 assures that a center 219 of the semiconductor wafer 130 is substantially aligned with the rotational axis (not shown) of the wafer carrier 210. Thus, non-concentric positioning of the semiconductor wafer 130 and any associated swirling are effectively eliminated with the present invention.

The polishing head 200 further comprises contraction devices, collectively designated 213, that operate the wafer holder 220. In the illustrated embodiment, the contraction devices 213 comprise vacuum operated pistons 213*a*–213*d* coupled together at a manifold 218 and coupled individually to respective arcuate segments 220*a*–220*d*. One who is skilled in the art will readily understand the contraction operation of the vacuum operated pistons 213*a*–213*d* when a vacuum is applied to the manifold 218. Although the illustrated embodiment shows four arcuate segments 220*a*–220*d*, one who is skilled in the art will recognize that the number of arcuate segments 220 may vary from 2 to n.

In other embodiments, the vacuum operated pistons 213*a*–213*d* may be replaced with hydraulically or pneumatically operated pistons (not shown). Likewise, the vacuum operated pistons 213*a*–213*d* may be replaced with individual or coupled gearing arrangements, e.g., bevel gears, rack and pinion, ring and pinion, etc. (not shown), to provide a purely mechanical contraction device 213 that may be operated by an appropriate tool (not shown) such as a hex wrench. The tool may also include a torque indicator, strain gauge, etc. (not shown) to assure that a pre-selected force is applied to grip the semiconductor wafer 230. Other systems, in addition to those just discussed above, that are apparent to those who are skilled in the art may also be used.

Figure 3A:
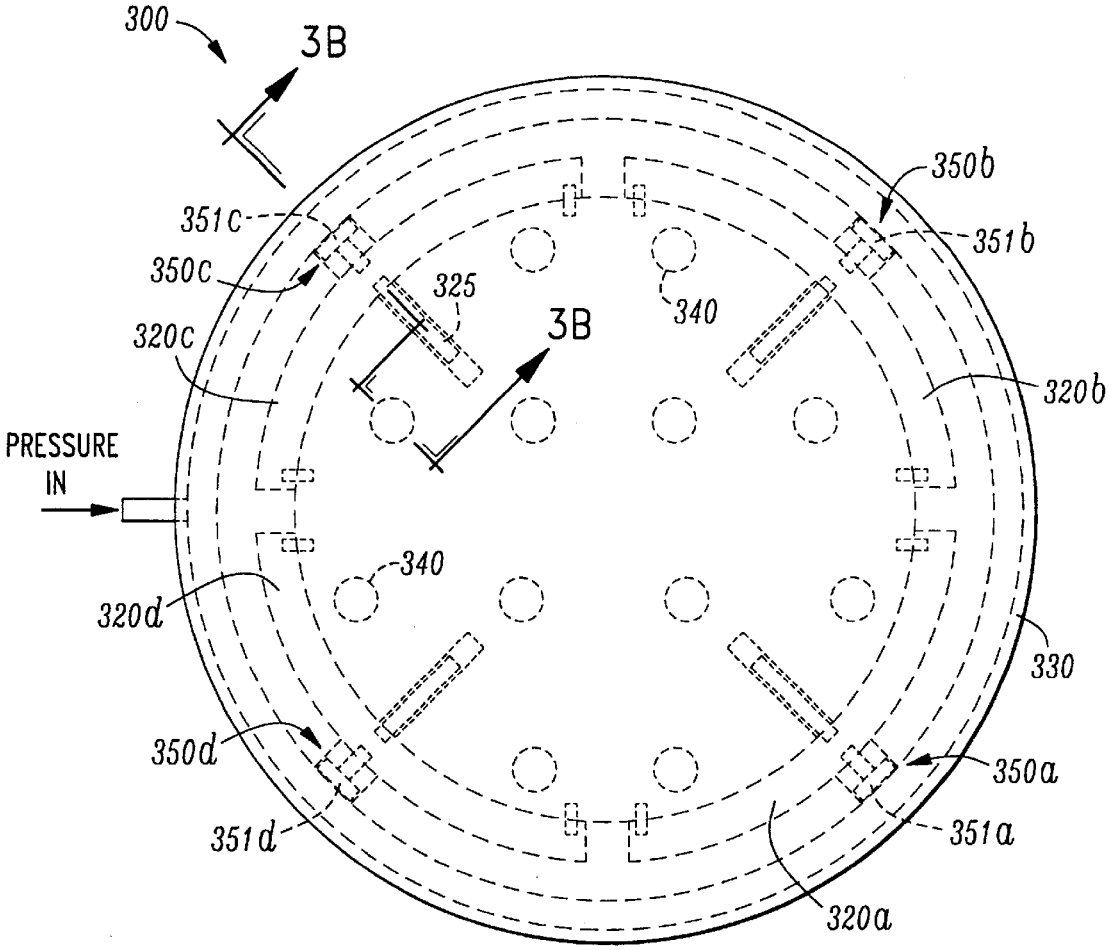
FIGS. 3A and 3B illustrate plan and sectional views of a second alternative embodiment of the polishing head of FIGS. 1A and 1B.
Figure 3B:
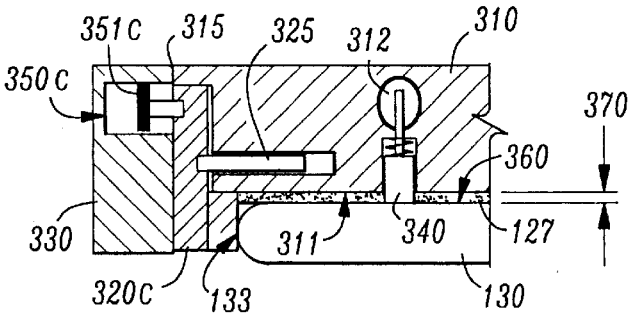

Referring now to FIGS. 3A and 3B, illustrated are plan and sectional views of an alternative embodiment of the polishing head of FIGS. 1A and 1B. A polishing head 300 comprises a wafer carrier 310 having an outer periphery 315, a segmented wafer holder, collectively 320, guides 325, an annulus 330 and depth sensors 340. The annulus 330 is coupled to the wafer carrier 310 and to the segmented wafer holder 320. The carrier film 127 is located between the wafer carrier 310 and the semiconductor wafer 130. In the illustrated embodiment, the annulus 330 depends from the outer periphery 315 and surrounds the segmented wafer holder 320. The polishing head 300 further comprises a contraction device 350 that is multiple pneumatic/hydraulic pistons 350*a*–350*d*. The multiple pneumatic/hydraulic pistons 351*a*–351*d* operate arcuate segments 320*a*–320*d* of the wafer holder 320 causing the arcuate segments 320*a*–320*d* to contract radially inward and grip the edge 133 of the semiconductor wafer 130. The semiconductor wafer 130 is retained by the wafer holder 320 by maintaining pressure on the pneumatic/hydraulic pistons 350*a*–350*d*.

The depth sensors 340 extend from an inner face 311 of the wafer carrier 310 to position a surface 360 of the semiconductor wafer 130 at a prescribed distance 370 from the inner face 311 when the semiconductor wafer 130 is selected from a supply table (not shown). The depth sensors 340 may be fixed within the wafer carrier 310. Alternatively, in the advantageous embodiment illustrated, the depth sensors 340 may be electrically extended from or retracted into the wafer carrier 310 by solenoid 312. The carrier film 127 may comprise a resilient material that allows some compression, thereby allowing for a variable distance 370. The sensors 340 may also be retracted by mechanical springs (not shown) and extended by pneumatic or hydraulic pressure. Of course, the sensors 340 may also be extended or retracted by electric motors (not shown).

Figure 4:
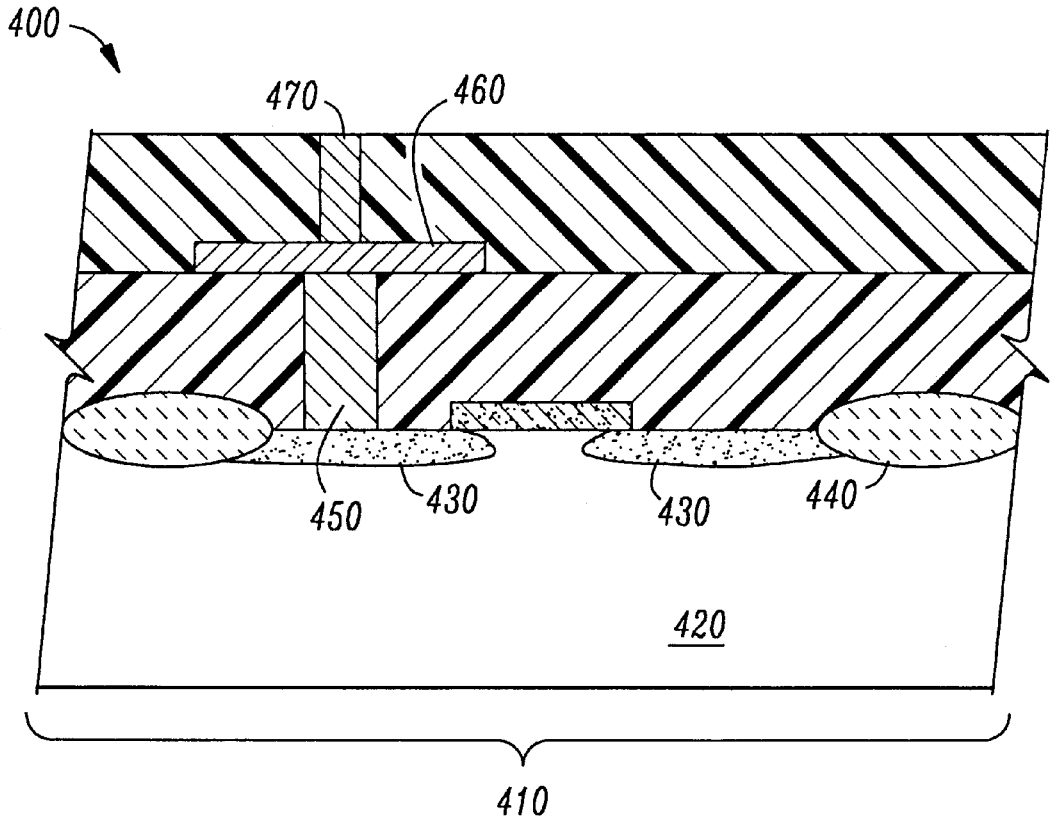
FIG. 4 illustrates a partial sectional view of a conventional integrated circuit that can be manufactured using a semiconductor wafer polishing head constructed in accordance with the principles of the present invention.

Referring now to FIG. 4, illustrated is a partial sectional view of a conventional integrated circuit 400 that can be manufactured using a semiconductor wafer polishing head constructed in accordance with the principles of the present invention. In this particular sectional view, there is illustrated an active device 410 that comprises a tub region 420, source/drain regions 430 and field oxides 440, which together may form a conventional transistor, such as a CMOS, PMOS, NMOS or bi-polar transistor. A contact plug 450 contacts the active device 410. The contact plug 450 is, in turn, contacted by a trace 460 that connects to other regions of the integrated circuit, which are not shown. A via 470 contacts the trace 460, which provides electrical connection to subsequent levels of the integrated circuit. Those who are skilled in the art are very familiar with such transistor devices in both structure and methods of fabrication thereof.

Thus, various embodiments of a semiconductor wafer polishing head have been described that include a wafer holder configured to grip an edge of a semiconductor wafer during CMP. The wafer holder may be a single annular band or constructed of multiple arcuate segments. The wafer holder may be operated by power derived from mechanical, electrical, vacuum, pneumatic or hydraulic sources.

Although the present invention has been described in detail, those skilled in the art should understand that they can make various changes, substitutions and alterations herein without departing from the spirit and scope of the invention in its broadest form.

What is claimed is:

1. For use in a polishing apparatus, a polishing head, comprising:

a wafer carrier having an outer periphery; and a wafer holder coupled to the wafer carrier and depending from the outer periphery, the wafer holder having a movable gripping element configured to radially contract to grip an edge of a semiconductor wafer.

2. The polishing head as recited in claim 1 wherein the movable gripping element is a collet.

3. The polishing head as recited in claim 2 wherein the collet comprises an annular band.

4. The polishing head as recited in claim 1 further comprising a wafer polishing film interposed the semiconductor wafer and the wafer carrier.

* * * * *